US005791689A

United States Patent [19]

Dovel

[11] Patent Number: 5,791,689

[45] Date of Patent: Aug. 11, 1998

[54] MULTIPLE LEAFLET LITERATURE ASSEMBLY

[75] Inventor: Keith R. Dovel, Kernersville, N.C.

[73] Assignees: Pharmagraphics (Midwest), L.L.C.; Pharmagraphics (Southeast), L.L.C., both of Greensboro, N.C.

[21] Appl. No.: 470,223

[22] Filed: Jun. 6, 1995

[51] Int. Cl.[6] ..... B42D 19/00

[52] U.S. Cl. ..... 281/5

[58] Field of Search ..... 283/81, 80, 79, 283/61, 62; 281/6, 5, 2

[56] References Cited

U.S. PATENT DOCUMENTS

| | | | |
|---|---|---|---|
| 4,010,964 | 3/1977 | Schechter | 283/62 |
| 4,583,763 | 4/1986 | Schaklett, Jr. | 283/62 X |
| 4,850,613 | 7/1989 | Instance | 283/62 X |
| 5,253,898 | 10/1993 | Mansione | 283/62 |
| 5,458,374 | 10/1995 | Vijnk et al. | 283/62 |

*Primary Examiner*—Willmon Fridie, Jr.

*Attorney, Agent, or Firm*—Myers Bigel Sibley & Sajovec, P.A.

[57] ABSTRACT

A literature assembly providing for verification of a plurality of leaflets of first and second types by inspecting only one leaflet of each type. The literature assembly includes a first leaflet secured to an assembly of leaflets, the assembly of leaflets including a plurality of integral and detachable leaflets. The first leaflet includes a first identifier and the assembly of leaflets includes a second identifier. Preferably, the first and second identifiers are electronically readable identifiers corresponding to information imprinted on each of the first and second leaflets, respectively. Each of the leaflets of the assembly of leaflets may be verified by inspecting a single panel of the assembly of leaflets.

18 Claims, 3 Drawing Sheets

MULTIPLE LEAFLET LITERATURE ASSEMBLY

FIELD OF THE INVENTION

The present invention is directed to literature leaflets and, more particularly, to a literature assembly including one or more assemblies of leaflets, each including a plurality of individual leaflets.

BACKGROUND OF THE INVENTION

For certain pharmaceutical products (e.g., birth control pills), the government has required that in addition to the mandatory disclosure information provided to the pharmacist and/or physician, there must also be a disclosure circular provided for the patient. The two circulars are quite different in terms of information. This requirement has posed a significant problem for the pharmaceutical industry in that pharmaceutical suppliers are required to insure that every lot of product is shipped with both types of disclosure circulars and that at least the required member be present. For products that are packed in a shipping case, the supplier must make certain that there is at least one patient package circular for every individual product container and at least one pharmacist/physician circular in the shipping carton.

Historically, pharmaceutical companies have had extra personnel on the packaging lines to place all of these different pieces of literature, often by hand, into shipping cases. This is a labor-intensive operation, and errors are often made. A critical error arises where the leaflets provided do not correspond to the pharmaceutical being shipped.

In a prior attempt to address this problem, applicant developed a machine designed to take two or more standard leaflets and glue them together in a stack, one leaflet on top of the other. FIG. 8 shows an example of an assemblage of leaflets according to this design. Patient leaflets 92, for example, are releasably adhered to the surface of one another and then to a physician leaflet 90 by adhesive 94. In the case of a pharmaceutical product requiring one pharmacist/physician leaflet and multiple patient leaflets, the pharmaceutical product may be supplied with a multiple leaflet assembly as shown in FIG. 8. This design provides several important benefits. The design provides for convenient packaging of the leaflets, exact quantities of each type of leaflet, and the potential for automatic application to a package.

While the above-disclosed design has some very important benefits, new Federal regulations due to take effect in the near future create a major drawback for that design. These regulations mandate that all pharmaceutical cut literature assemblies, including leaflets in the form of outserts and inserts, must be verified electronically prior to application to a pharmaceutical product. The most cost-effective means of electronic verification is a bar code. The problem with the above-disclosed design is that if there are more than two leaflets separately formed and joined together in a stack, it is not feasible to verify each component electronically by a bar code (e.g., for a three leaflet label, one could electronically verify the two leaflets on the ends of the assemblage, but could not verify the leaflet sandwiched between the other two). Thus, for accurate and convenient electronic verification, the design disclosed above is only appropriate for literature assemblies having two leaflets.

Thus, there exists the need for a multiple leaflet assembly which provides for accurate and convenient verification of a plurality of extended text leaflets forming a single literature assembly.

SUMMARY OF THE INVENTION

The present invention is directed to a literature assembly providing for verification of all of one or more leaflets of a first type and each of a plurality of leaflets of a second type by inspecting only one leaflet of each type. Each of the second leaflets are provided in an assembly of leaflets formed from an integral sheet such that each of the second leaflets includes multiple panels and all of the second leaflets may be verified by inspecting only one panel of only one second leaflet.

The literature assembly includes a first leaflet which may be, for example, a physician/pharmacist leaflet, having a first identifier and an assembly of leaflets secured to the first leaflet and having a second identifier. The assembly of leaflets is formed from a single sheet, wherein the sheet is folded about a first series of one or more fold lines and about a second series of one or more fold lines transverse to the first series to form a plurality of second leaflets which may be , for example, patient leaflets. The sheet is divided by the aforementioned fold lines into at least four panels. The second fold line defines at least a pair of second leaflets, one of the second leaflets disposed on either side of the second fold line. Additionally, a tear line is provided at the second fold line. Respective second leaflets may be detached from one another by tearing along the tear line. Preferably, the first leaflet is releasably secured to the assembly of leaflets. Furthermore, the first and second identifiers preferably include electronically readable identifiers (bar codes or two-dimensional codes) corresponding to information imprinted on each of the first leaflet and the second leaflet, respectively.

Literature assemblies according to the present invention may be formed by the following method. The assembly of leaflets is formed by folding a single sheet about a first fold line, then folding the sheet about a second line transverse to the first fold line, thereby forming a pair of leaflets defined on either side of the second fold line. A tear line is formed at the second fold line. A first identifier is imprinted on the first leaflet. A second identifier is printed on the assembly of leaflets. The assembly of leaflets is releasably secured to the first leaflet.

Literature assemblies according to the present invention may be used as follows. The first and second identifiers are electronically read in order to verify the first and second leaflets. The literature assembly is placed in or on a package. Thereafter, the first leaflet is removed from the assembly of leaflets and/or one or more of the second leaflets are detached from one another by tearing along the aforementioned tear line.

An object of the present invention is to provide a literature assembly for placement in or on a package.

An object of the present invention is to provide a multiple leaflet literature assembly which provides for accurate and convenient verification of a plurality of leaflets forming a single literature assembly.

An object of the present invention is to provide a literature assembly as described above which may be cost-effectively manufactured.

An object of the present invention is to provide a literature assembly as described above which lends itself to manufacture by automatic production apparatus.

An object of the present invention is to provide a literature assembly which minimizes or eliminates errors associated with the matching of dissimilar but related extended text literature leaflets.

DETAILED DESCRIPTION OF THE INVENTION

Figure 1:
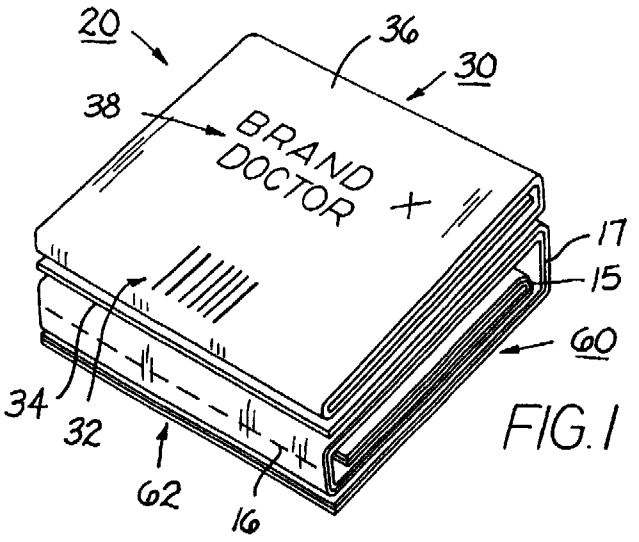
FIG. 1 is a perspective view of a multiple leaflet literature assembly according to the present invention including an assembly of leaflets.

The term "leaflet" as used herein means any type of extended text literature assembly, whether intended as an outsert, i.e., for placing on the exterior of a package, or as an insert, i.e., for placing within a package. Moreover, except as may be critical to the formation of the literature assembly according to the present invention, a leaflet may be of any suitable formation, e.g., spirally or fan-folded, and is in no way intended to be restricted to the exact embodiment described hereafter which is merely illustrative of a preferred embodiment.

With reference to FIGS. 1–7, a literature assembly according to the present invention and indicated generally by the numeral 20 is shown therein. Literature assembly 20 includes first leaflet or physician/pharmacist leaflet 30 and assembly of leaflets 60. Bottom panel 34 of first leaflet 30 is releasably secured to panel 7 of assembly of leaflets 60 by adhesive spots 50. Adhesive 50 is preferably Fuller Adhesive Product No. HL2198.

Figure 2:
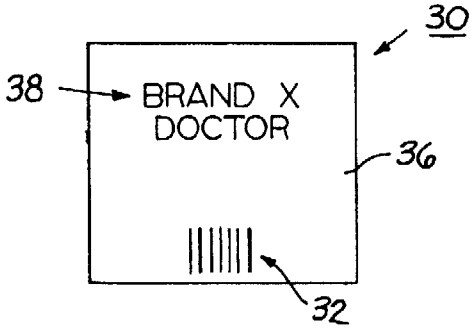
FIG. 2 is a top plan view of the literature assembly of FIG. 1.

As best seen in FIG. 2, top or title panel 36 of physician/pharmacist leaflet 30 has imprinted thereon commonly readable indicia 38 and electronically readable identifier 32, preferably a bar code. Indicia 38 serves to inform the user that first leaflet 30 includes a first type of information, such as, for example, information for the physician or pharmacist distributing a pharmaceutical product. Identifier 32 is coded to correspond to a record in an electronic database and corresponds to the information indicated by indicia 38.

Figure 3:
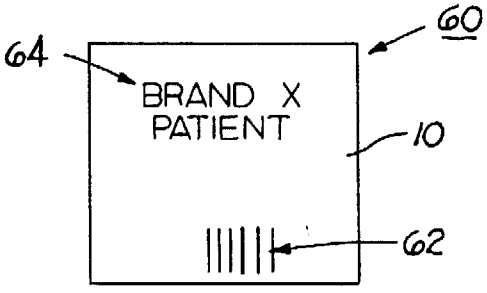
FIG. 3 is a bottom plan view of the literature assembly of FIG. 1.

As best seen in FIG. 3, bottom or title panel 10 of assembly of leaflets 60 has imprinted thereon indicia 64 and electronically readable identifier 62, preferably a bar code. Indicia 64 serves to inform the user that assembly of leaflets 60 includes a second type of information, such as, for example, information for the patient receiving the same particular pharmaceutical product as included in physician/pharmacist leaflet 30. Identifier 62 is coded to correspond to a record in an electronic database and corresponds to the information indicated by indicia 64.

Figure 4:
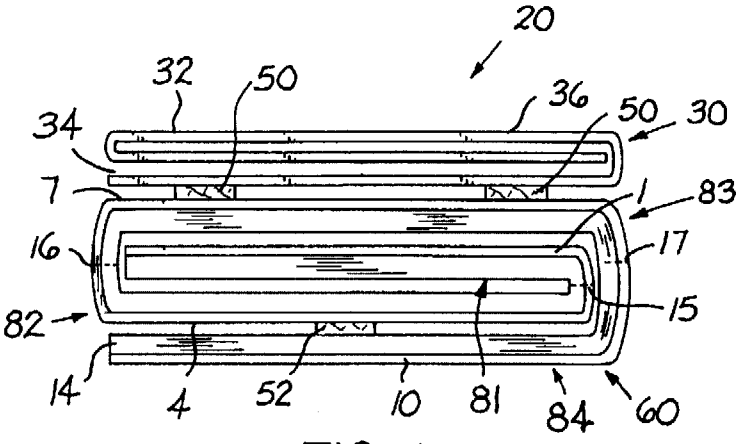
FIG. 4 is a side elevational view of the literature assembly of FIG. 1.

Turning now to FIG. 4 in more detail, physician/pharmacist leaflet 30 is shown as a common, spirally-folded "ribbon," extended text leaflet. It will be appreciated that physician/pharmacist leaflet 30 may be any type of single or multiple panel leaflet including an assembly of leaflets identical or similar to assembly of leaflets 60.

Assembly of leaflets 60 is similarly spirally folded. It will be appreciated that assembly of leaflets 60 may likewise be fan-folded or otherwise folded as best suits the needs of the user and/or manufacturing process and apparatus.

Referring now to assembly of leaflets 60 in greater detail, it will be seen that assembly of leaflets 60, as shown in FIG. 4, is divided into four second leaflets or patient leaflets 81, 82, 83, 84. Patient leaflets 81 and 82 are separated by tear line 15; patient leaflets 82 and 83 are separated by tear line 16; patient leaflets 83 and 84 are separated by tear line 17.

Figure 5:
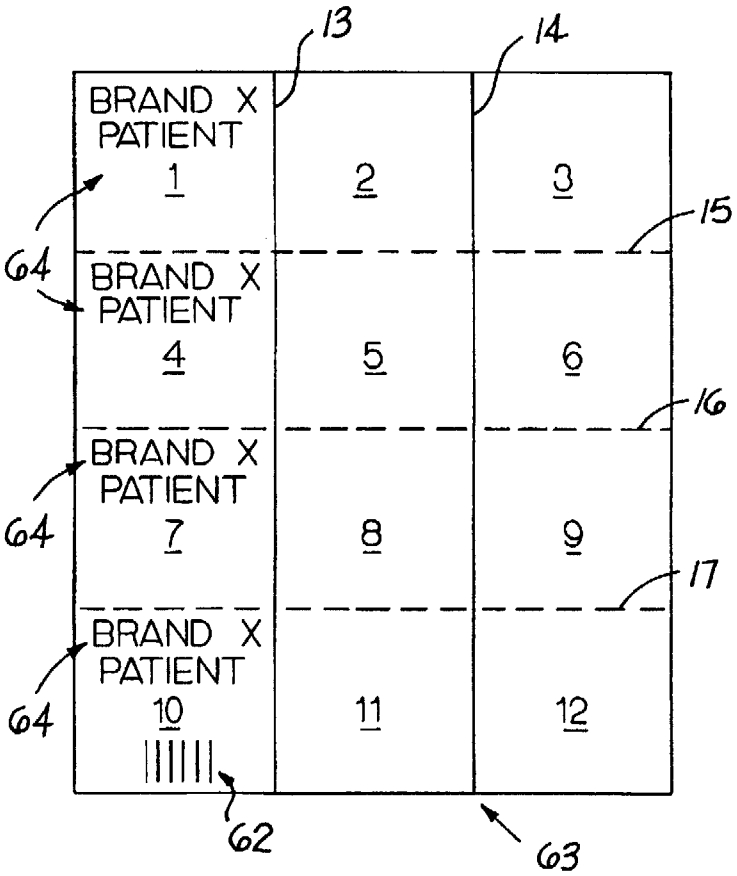
FIG. 5 is a top plan view of the sheet forming the assembly of leaflets of the present invention, the sheet being unfolded.
Figure 8:
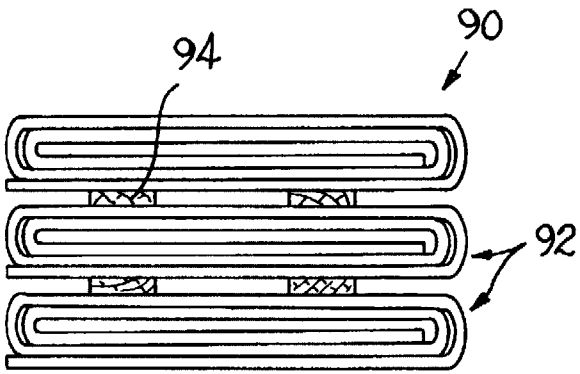
PRIOR ART FIG. 8
FIG. 8 is a multiple leaflet literature assembly according to applicant's prior art design.

The actual construction of assembly of leaflets 60 and patient leaflets 81, 82, 83, 84 is best understood by reference to FIGS. 4–7. As best seen in FIG. 5, sheet 63 includes panels 1–12. Panels 1–12 are defined by longitudinal fold lines 13, 14 and transverse fold/tear lines 15, 16, 17. Patient leaflet 81 is formed from panels 1–3; patient leaflet 82 is formed from panels 4–6; patient leaflet 83 is formed from panels 7–9; patient leaflet 84 is formed from panels 10–12. Each of panels 1, 4, 7, and 10 serve as title panels for the individual patient leaflets and have imprinted thereon indicia 64. Panel 10 also serves as the title panel for assembly of leaflets 60 and has identifier 62 imprinted thereon.

Figure 6:
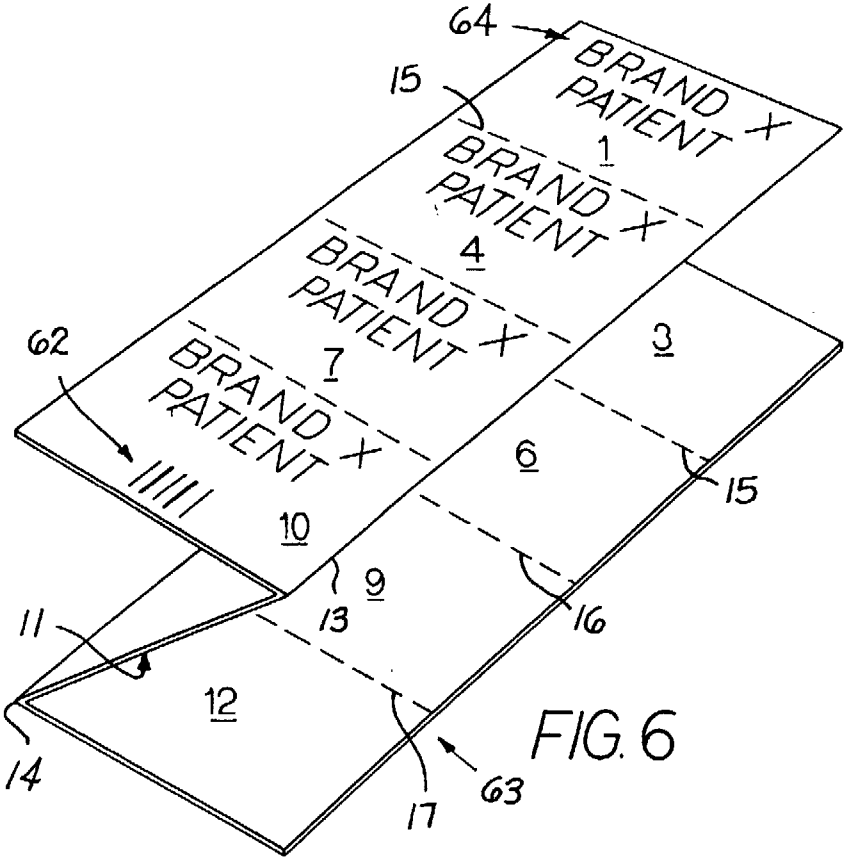
FIG. 6 is a perspective view of the sheet forming the assembly of leaflets according to the present invention, the sheet being folded about the longitudinal fold lines.

Assembly of leaflets 60 is constructed as follows. As shown in FIG. 6, panels 1, 4, 7, and 10 are folded about longitudinal fold line 13 back onto panels 2, 5, 8, and 10, respectively, and panels 2, 5, 8, and 11 are folded about longitudinal fold line 14 forward onto panels 3, 6, 9, and 12, respectively. Next, panels 1, 2, and 3 are folded about transverse fold line 15 downwardly and under panels 4, 5, and 6. Panels 4, 5, and 6 are folded downwardly and under about transverse fold line 16, placing panels 1–6 beneath panels 7, 8, and 9. Finally, panels 7, 8, and 9 are folded about transverse fold line 17, placing panels 1–9 beneath panels 10, 11, and 12, thereby forming assembly of leaflets 60 as shown in FIG. 4. Preferably, transverse fold lines 15, 16, 17 are formed at a right angle to longitudinal fold lines 13, 14, as shown in the figures. Adhesive spot 52 is placed between panels 12 and 4 to hold assembly of leaflets 60 in the folded configuration.

Figure 7:
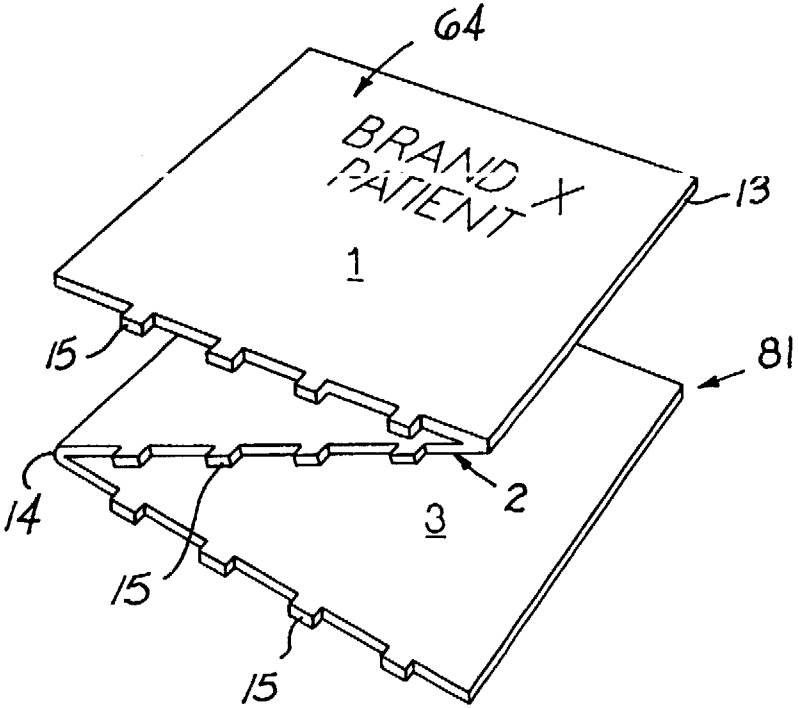
FIG. 7 is a perspective view of a second leaflet removed from the assembly of leaflets according to the present invention, the sheet being folded about the transverse fold lines.

Each of patient leaflets 81, 82, 83, and 84 may be removed from assembly of leaflets 60 by tearing along respective tear lines 15, 16, and 17. For example, as shown in FIG. 7, patient leaflet 81 which consists of panels 1, 2, and 3 may be detached from assembly of leaflets 60 by tearing along tear line 15. The assembly of leaflets may then be refolded. Tear lines 15, 16, 17 are preferably perforations.

It will be appreciated that assembly of leaflets 60 may be formed from any number of longitudinal and transverse fold lines, there being at least one of each. Thus, there could be as few as two patient leaflets.

Assembly of leaflets 60 provides several significant benefits. Multiple individual leaflets may be formed from a single printing step on the sheet. Multiple leaflet literature assemblies may be provided with little or no use of adhesive to hold the leaflets together.

Literature assembly 20 has as a primary advantage, in addition to the benefits of assembly of leaflets 60, convenient and reliable verification of all of the physician/pharmacist and patient leaflets by electronic reading means. Because patient leaflets 81, 82, 83, 84 are printed on one sheet 63, each of patient leaflets 81, 82, 83, 84 may be guaranteed to be of the same type. Thus, identifier 62 corresponds to all of patient leaflets 81, 82, 83, 84. Identifier 62 may be read by a reader passing below literature assembly 20, and identifier 32 of physician/pharmacist leaflet 30 may be read by a reader passing above literature assembly 20. In this way, all of the physician/pharmacist and patient leaflets are verified in a single pass through a simple, two-sensor electronic reader apparatus and only panels 36 and 10 need be exposed to the reader.

The information printed on each of patient leaflets 81, 82, 83, 84 may be the same for distribution to different patients or may be different but related information for distribution to one patient (e.g., daily instructions).

Certain improvements and modifications will be readily apparent to those skilled in the art upon a reading of the foregoing description of the preferred embodiment. For example, the individual title panels may be numbered to aid the user in keeping track of the number of leaflets, and thus, sub-packages, dispensed. All such improvements and modifications are intended to come within the scope of the claims which follow.

What is claimed:

1. A literature assembly, comprising:

a. a first leaflet including a first identifier; and b. an assembly of leaflets separately formed from and detachably secured to said first leaflet and including a second identifier, said assembly of leaflets including a plurality of integrally formed second leaflets, said second leaflets detachably secured to one another wherein said first leaflet is releasably adhered by adhesuve to said assembly of leaflets.

2. The literature assembly of claim 1 wherein said first and second identifiers include electronically readable identifiers corresponding to information imprinted on each of said first leaflet and said second leaflets, respectively.

3. The literature assembly of claim 2 wherein said first and second identifiers are imprinted on opposed, exposed panels of said first leaflet and said assembly of leaflets, respectively.

4. The literature assembly of claim 1 including at least three said second leaflets.

5. The literature assembly of claim 1 wherein each of said second leaflets includes at least two panels joined along a fold line such that each said leaflet includes multiple panels.

6. The literature assembly of claim 1 wherein said first leaflet includes at least two panels joined along a fold line.

7. An assembly of leaflets, comprising:

a. a single sheet;

b. wherein said sheet is folded about a first longitudinal fold line and about second and third fold lines spaced apart from one another and transverse to said first fold line, whereby said sheet is divided into at least six panels, said second and third fold lines defining at least three multipanel leaflets, said leaflets disposed on either side of and between said second and third fold lines; and c. tear lines provided at said second fold line and at said third fold line whereby respective said leaflets may be detached from one another.

8. The assembly of claim 7 wherein each of said leaflets has substantially the same indicia imprinted thereon.

9. A literature assembly, comprising:

a. a first leaflet including a first identifier; and b. an assembly of leaflets separately formed from and detachably secured to said first leaflet and including a second identifier, said assembly of leaflets including:

(1) a single sheet, (2) wherein said sheet is folded about a first longitudinal fold line and about second and third fold lines spaced apart from one another and transverse to said first fold line, whereby said sheet is divided into at least six panels, said second and third fold lines defining at least three multipanel second leaflets, said second leaflets disposed on either side of and between said second and third fold lines; and (3) tear lines provided at said second fold line and at said third fold line whereby respective said second leaflets may be detached from one another.

10. The literature assembly of claim 9 wherein said first leaflet is releasably secured by adhesive to said assembly of leaflets.

11. The literature assembly of claim 9 wherein said first and second identifiers include electronically readable identifiers corresponding to information imprinted on each of said first leaflet and said second leaflets, respectively.

12. A method for using a multiple leaflet literature assembly, the multiple leaflet literature assembly including a first leaflet having first indicia thereon, an assembly of leaflets secured to the first leaflet and including second indicia thereon, the assembly of leaflets comprising a single sheet wherein the sheet is folded about a first fold line and about a second fold line transverse to the first fold line, whereby the sheet is divided into at least four panels, the second fold line defining a pair of second leaflets, one of the second leaflets disposed on either side of the fold line, and a tear line provided along the second fold line, comprising the steps of:

a. imprinting on the first leaflet a first identifier corresponding to the first indicia;

b. imprinting on the assembly of leaflets a second identifier corresponding to the second indicia;

c. securing the first leaflet to the assembly of leaflets;

d. electronically reading the first and second identifiers while the first leaflet and the assembly of leaflets are secured to one another in order to verify that the first and second leaflets are properly matched;

e. placing the literature assembly on or in a package;

f. removing the first leaflet from the assembly of leaflets; and g. detaching the second leaflets from one another by tearing along the tear line.

13. An assembly of leaflets, comprising:

a. a single sheet;

b. wherein said sheet is folded about a first fold line and about a second fold line transverse to said first fold line, whereby said sheet is divided into at least four panels, said second fold line defining a pair of leaflets, one of said leaflets disposed on either side of said second fold line;

c. a tear line provided at said second fold line whereby respective leaflets may be detached from one another; and d. wherein each of said leaflets has substantially the same indicia imprinted thereon.

14. The literature assembly of claim 9 wherein said first and second identifiers are imprinted on opposed, exposed panels of said first leaflet and said assembly of leaflets, respectively.

15. The literature assembly of claim 9 including at least three said second leaflets.

16. The literature assembly of claim 9 wherein each of said second leaflets includes at least two panels joined along said first fold line such that each said second leaflet includes multiple panels.

17. The literature assembly of claim 9 wherein said first leaflet includes at least two panels joined along a fourth fold line.

18. The method of claim 12 wherein said step of imprinting a first identifier includes printing the first identifier on an exposed panel of the first leaflet and said step of imprinting a second identifier includes printing the second identifier on an exposed panel of the assembly of leaflets opposite the exposed panel of the first leaflet.

* * * * *